US006763201B1

(12) United States Patent
Reijnders

(10) Patent No.: US 6,763,201 B1
(45) Date of Patent: Jul. 13, 2004

(54) METHOD FOR DETERMINATION OF ALTITUDE IN AN XEROGRAPHIC PRINTER

(75) Inventor: Harry j. M. Reijnders, Venray (NL)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/376,091

(22) Filed: Feb. 27, 2003

(51) Int. Cl.[7] ..... G03G 15/02
(52) U.S. Cl. ..... 399/50; 399/171
(58) Field of Search ..... 399/50, 168, 170, 399/171; 250/324, 325, 326; 361/229, 230, 213

(56) References Cited

U.S. PATENT DOCUMENTS 3,675,011 A * 7/1972 Silverberg ..... 250/326
5,181,070 A * 1/1993 Masuda ..... 399/171
5,359,393 A * 10/1994 Folkins ..... 399/50
6,266,494 B1 7/2001 Budnik et al. ..... 399/55
6,681,084 B1 * 1/2004 Reijnders

FOREIGN PATENT DOCUMENTS

JP 2001175056 A * 6/2001 ..... G03G/15/02

* cited by examiner

*Primary Examiner*—Susan S. Y. Lee
(74) *Attorney, Agent, or Firm*—Lloyd F. Bean, II

(57) ABSTRACT

A method for determining an altitude with a corona generating device having a grid and a coronode and a power supply for supply power to the grid and coronode, including: setting the grid at a predefined voltage with the power supply; applying a charge output voltage and a charged output current to the coronode with the power supply; monitoring the charged output voltage and the charge output current to the coronode from the power supply until a predefined charge output voltage is reached; correlating charged output current to an altitude when the predefined charge output voltage is reached.

10 Claims, 5 Drawing Sheets

METHOD FOR DETERMINATION OF ALTITUDE IN AN XEROGRAPHIC PRINTER

Reference is made to commonly-assigned U.S. patent application Ser. No. 10/376,093 now U.S. Pat. No. 6,681,084, filed concurrently herewith, entitled "Method For Determination Of Humidity In An Xerographic Printer," by Reijnders, the disclosure of which is incorporated herein.

This invention relates generally to a corona generating device, and more particularly concerns a method and apparatus for determining altitude with a corona generating device, in order to adjust xerographic settings.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith.

Generally, the developer material comprises toner particles adhering triboelectrically to carrier granules. The toner particles are extracted from the carrier granules to the latent image forming a toner powder image on the photoconductive member. The toner powder image is then transferred from the photoconductive member to a copy sheet. The toner particles are heated to permanently affix the powder image to the copy sheet. In printing machines such as those described above, corona devices perform a variety of other functions in the printing process.

For example, corona devices aid the transfer of the developed toner image from a photoconductive member to a transfer member. Likewise, corona devices aid the conditioning of the photoconductive member prior to, during, and after deposition of developer material thereon to improve the quality of the electrophotographic copy produced thereby. Both direct current (DC) and alternating current (AC) type corona devices are used to perform these functions. One form of a corona charging device comprises a corona electrode in the form of an elongated wire connected by way of an insulated cable to a high voltage AC/DC power supply.

The scorotron is similar to the pin corotron, but is additionally provided with a screen or control grid disposed between the coronode and the photoconductive member. The screen is held at a lower potential approximating the charge level to be placed on the photoconductive member. The scorotron provides for more uniform charging and prevents over charging.

A problem with xerographic printing systems is that these systems are affected by the environment in which these system are placed. For example, detack corotron AC voltages are required for different altitude conditions to obtain optimal performance of the xerographic printing systems. In U.S. Pat. No. 6,266,494 teaches that in any xerographic development system in which there is a substantial potential relative to the photoconductive, but particularly when there exists an alternating current field across a development gap, there is a practical risk of arcing across the gap. Such arcing will of course have a deleterious effect on the operation of the printing apparatus, causing at the very least a print defect and at worst damage to the apparatus. The various control systems for maintaining print quality in any xerographic printing apparatus are liable to cause the various potentials associated with the xerographic process to reach such levels that arcing is possible. The risk of arcing is particularly increased in situations where the printing apparatus is installed at high altitudes, such as in mountainous regions. The relatively low air pressure at higher altitudes can lead to Paschen breakdown, that is, the ionization of air molecules which leads to arcing, at much lower potentials than would occur at lower altitudes.

Hereinbefore, xerographic printing systems capable of being adjusted for different altitudes require the service operator to look up the altitude and input the value for setting machine parameters. Therefore, it is desirable to be able to easily determine and input the altitude of the xerographic printing systems without operator intervention.

There is provided a method for determining an altitude with a corona generating device having a grid and a coronode and a power supply for supply power to said grid and coronode, comprising: setting the grid at a predefined voltage with the power supply; applying a charge output voltage and a charge output current to the coronode with the power supply; monitoring the charge output voltage and the charge output current to the coronode from the power supply until a predefined charge output voltage is reached; correlating charge output current to an altitude when said predefined charge output voltage is reached.

There is also provided an electrostatic printing machine having a method for determining an altitude with a corona generating device having a grid and a coronode and a power supply for supply power to said grid and coronode, comprising: setting the grid at a predefined voltage with the power supply; applying a charge output voltage and a charge output current to the coronode with the power supply; monitoring the charge output voltage and the charge output current to the coronode from the power supply until a predefined charge output voltage is reached; correlating charge output current to an altitude when said predefined charge output voltage is reached.

Other features of the present invention will become apparent as the following description proceeds and upon reference to the drawings, in which.

Figure 1:
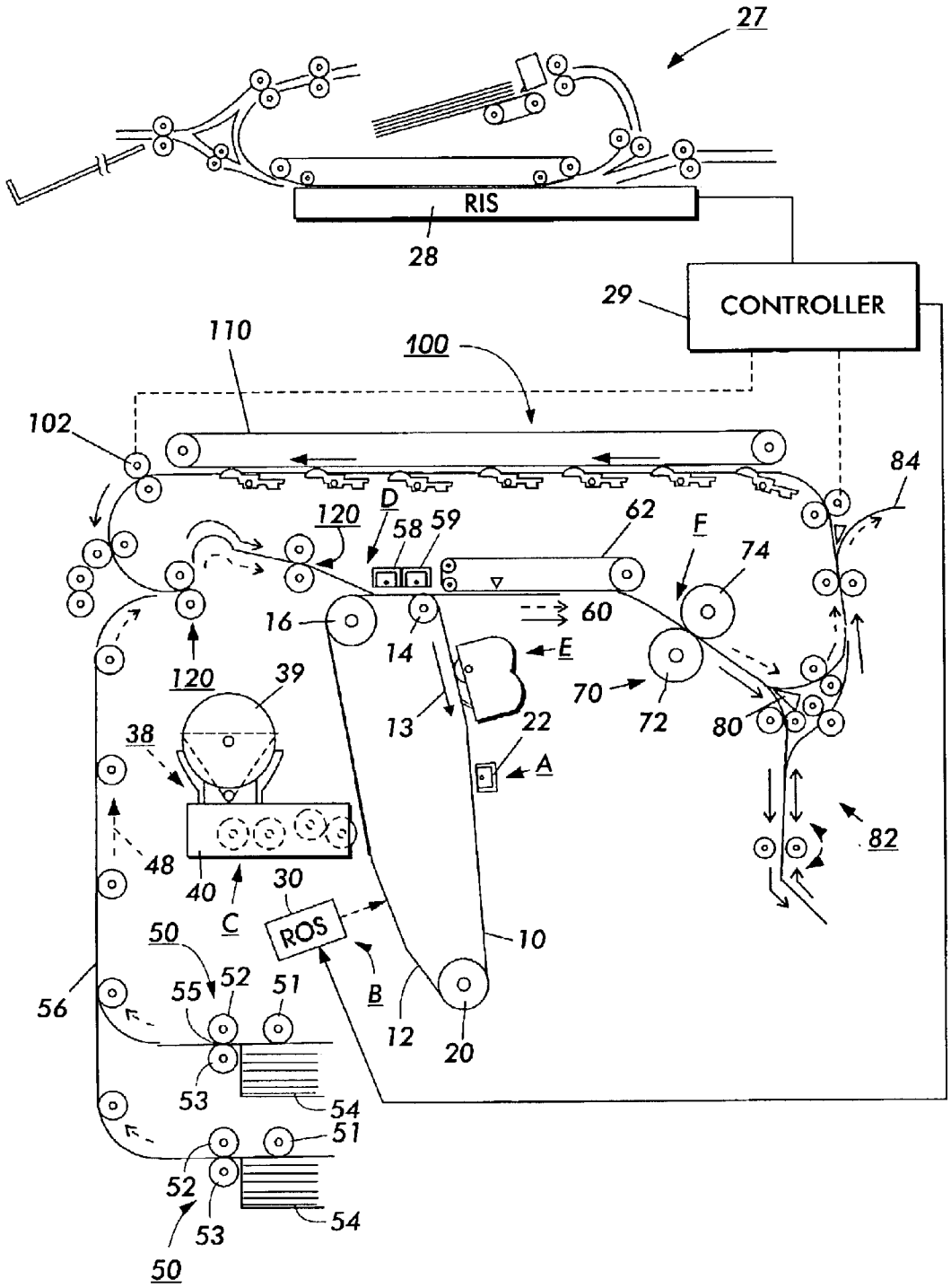
FIG. 1 is a schematic elevational view of a typical electrophotographic printing machine utilizing the corona shield of the present invention.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

FIG. 1 schematically depicts an electrophotographic printing machine incorporating the features of the present invention therein. It will become evident from the following discussion that the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive, and a charge coupled device (CCD) array. The RIS captures the entire original document and converts it to a series of raster scan lines. This information is transmitted to an electronic subsystem (ESS) which controls a raster output scanner (ROS) described below. FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Photoconductive belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13. Initially, a portion of the photoconductive surface passes through charging station A.

At charging station A, a corona generating device indicated generally by the reference numeral 22 charges the photoconductive belt 10 to a relatively high, substantially uniform potential. At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator. For example, the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks.

The ROS 30 will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis. After the electrostatic latent image has been recorded on photoconductive surface 12, photoconductive belt 10 advances the latent image to a development station, C, where toner, in the form of liquid or dry particles, is electrostatically attracted to the latent image using commonly known techniques.

The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on photoconductive belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56.

Vertical transport 56 directs the advancing print sheet 48 of support material into the registration transport 120, past image transfer station D to receive an image from photoconductive belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoconductive by corona generating device 59 which sprays oppositely charged ions onto the back side of sheet 48 to assist in removing the sheet from the photoconductive. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roller 72. The sheet then passes through fuser assembly 70 where the image is permanently fixed or fused to the sheet. After passing through fuser assembly 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84.

However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for re-circulation back through transfer station D and fuser assembly 70 for receiving and permanently fixing the side two image to the backside of that duplex sheet, before it exits via exit path 84. After the print sheet is separated from photoconductive surface 12 of belt 10, the residual toner/developer and paper fiber particles adhering to photoconductive surface 12 are removed therefrom at cleaning station E.

Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. Controller 29 can receive a signal from the altitude sensor of the present invention and can adjust development parameters of the development system and charging parameter of the charging system to optimize the functioning of the printer machine at the altitude sensed. The controller is preferably a programmable microprocessor which controls all of the machine functions hereinbefore described. The controller provides a comparison count of the copy sheets, the number of documents being re-circulated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
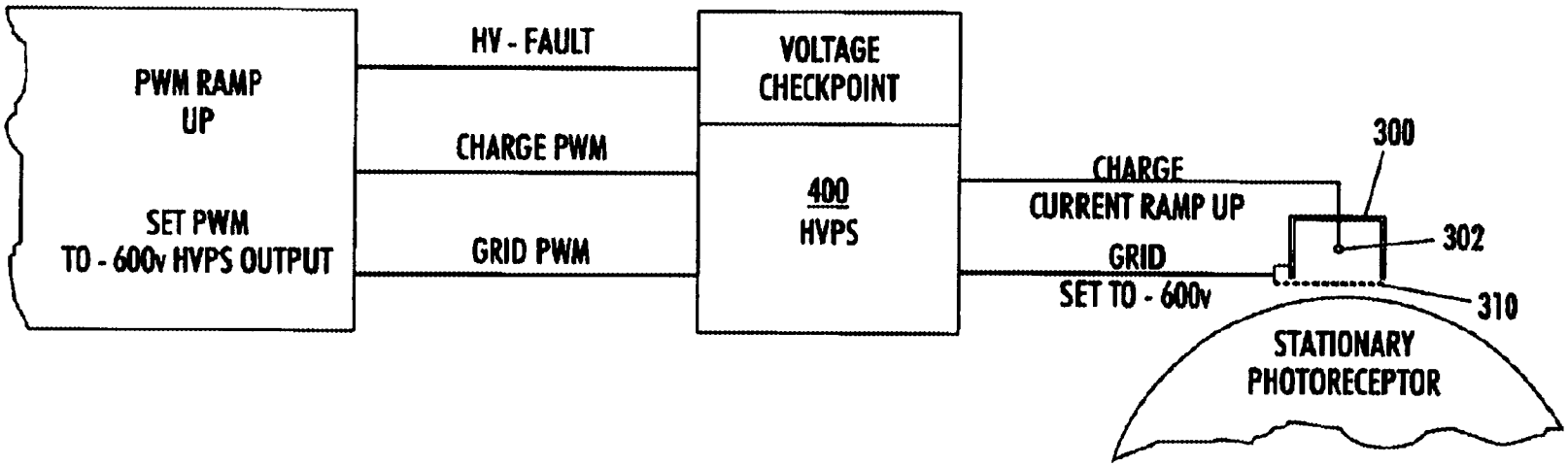
FIG. 2 is a schematic of the photoconductive charging system which includes a power supply and a charging device employed with the present invention.
Figure 3:
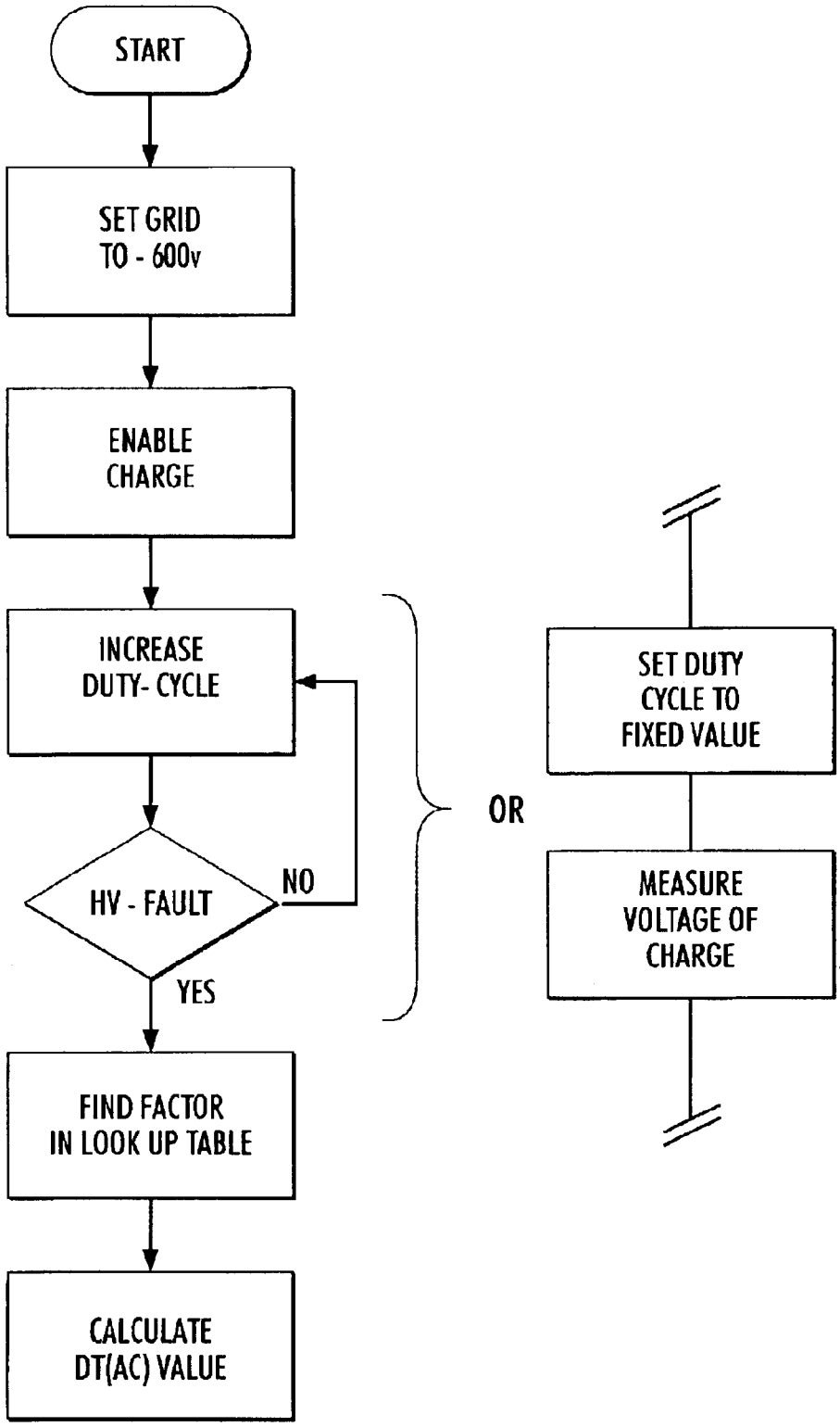
FIG. 3 is a flow chart illustrating the operation of the present invention.

Turning next to FIG. 2, there is shown a schematic of the charging device and power supply 400 of the present invention. Grid 310 which is enclosed by shield 300. The charging devices includes end blocks (not shown), which support wire conductor 302. The figure illustrates wire conductors 302 for corona generation. However, pin type conductors may also be employed which comprises an array of pins integrally formed from a sheet metal member.

Now referring to the present invention in more detail, the present invention employs the use of charge scorotron in combination with the high voltage supply, and a software routine to accurately determine altitude environment. This information can then be used to optimize other xerographic settings, among which the AC voltage setting of the Detack Scorotron and developer system settings. The geometry of the charge scorotron is very accurately defined: grid 310 having a predefined open area, a coronode 302 having a known coronode-grid spacing, and coronode-shield spacing is also known. The grid-photoconductive spacing is accurately defined. Applicant has found that if the scorotron is driven with a constant current source, the high voltage required to generate the required total wire current mainly varies because of environmental conditions, of which altitude and humidity are the major ones. If the photoconductive is stationary in a dark environment the normal process current into the photoconductive is not flowing. The photoconductive will just charge up the grid level. In practice, it is preferable to perform the measurements against a moving photoconductive, to prevent possible damage of the photoconductive. The dark decay current is negligible against the total wire current.

The high voltage power supply 400 is designed as such that there is an accurate relation between the duty cycle of the charge PWM input signal, and the HVPS charge output channel whereas, for example, 20% duty equals −500 $\mu\Delta$ and 100% duty equals −1500 $\mu\Delta$. A preferred power is of the type found in the Xerox Document Centre® 555/545/535 made by Xerox Corporation. As an illustrative example, a high voltage power supply with D.C. Input. Electrical connection between the ground of the input (24V RTN.) and the common ground of the high voltage outputs (high voltage RTN) exist within the power supply. The power supply includes the following PWM *programmable outputs. Pulse Width Modulation input signals at frequency of 4 kHz and the following outputs:

| | |
|---|---|
| Charge (C): | DC negative constant current output |
| Grid (G): | DC negative constant voltage output |
| Transfer current (T): | DC positive constant current output |
| Detack(AC): | AC constant voltage output (sine wave 650 Hz) |

-continued

| | |
|---|---|
| Detack(DC): | DC constant negative or positive current which is superimposed on the DT(AC) |
| Developer bias (DB): | DC negative constant voltage output |
| Charge bias (CB): | DC positive or negative constant voltage output |

Outputs: C, DT(AC), CB

Activation of output at typical 0.15 (15%) duty of PWM signal Output defined from duty 0.2 onwards Outputs: T, CB Activation of output at typical 0.05 (5%) duty of PWM signal Output defined from duty 0.1 onwards PWM Setting of Outputs:

The output value of the outputs C,G,T DT(AC), DT(DC), and DB can be set to any value output adjustment range by using following calculation:

OUTPUT LEVEL = BASE LEVEL + DUTY (MAX. LEVEL − BASE LEVEL).

| LEVELS: DEFINED: | FORMULA: | OUTPUT ENABLED: TYPICAL | OUTPUT |
|---|---|---|---|
| CHARGE (uA) = | −(250 + DUTY × (1250)) | DUTY > 0.15 | DUTY >= 0.2 |
| GRID (V) = | −(300 + DUTY × (400)) | When CHARGE is on. | DUTY >= 0 |
| TRANSFER (uA) = | 78 + DUTY × (722) | DUTY > 0.05 | DUTY >= 0.1 |
| DETACK(AC) (V) = | 2500 + DUTY × (2500) | DUTY > 0.15 | DUTY >= 0.2 |
| DETACK(DC) (uA) = | 20 − DUTY × (220) | When DT(AC) is on. | DUTY >= 0 |
| DEV. BIAS (V) = | DUTY (−500) | DUTY > 0.15 | DUTY >= 0.2 |
| CB (V) = | −655 + DUTY (1555) | DUTY > 0.05 | DUTY >= 0.1 |

Figure 4:
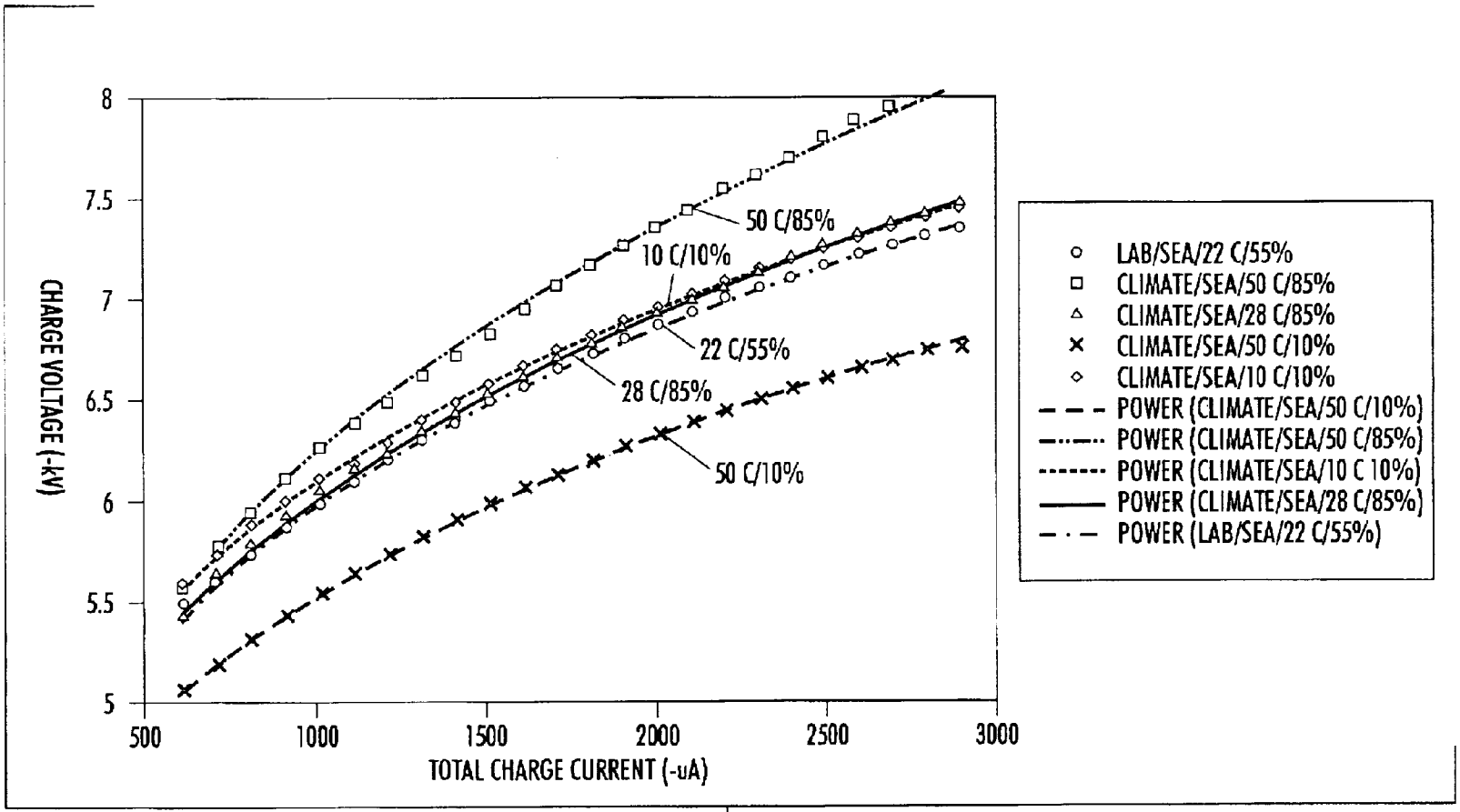
FIGS. 4 and 5 illustrate test data which can be employed in a look up table to determine enviromental parameters.
Figure 5:
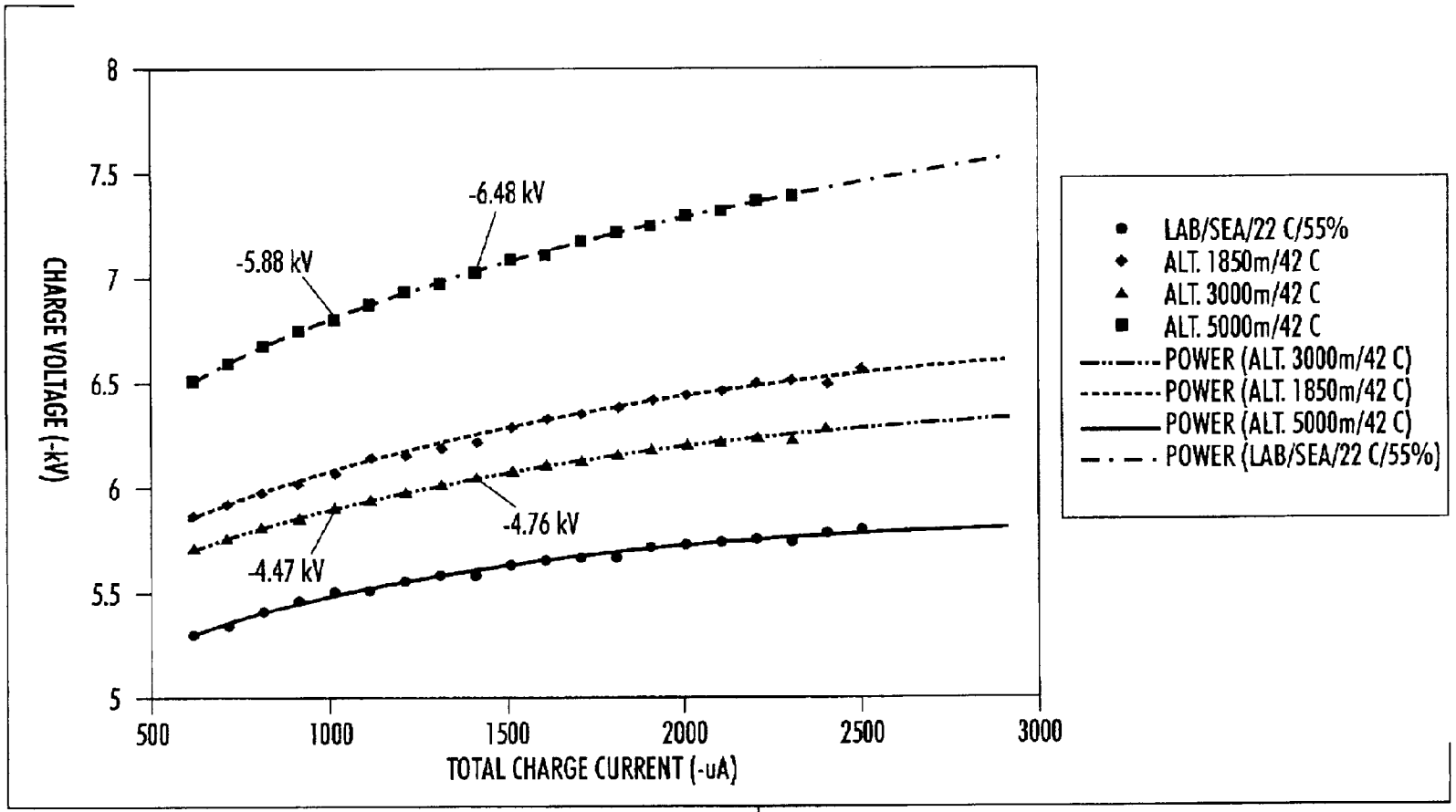

FIGS. 4 and 5 show the relation between the total wire current and the corresponding generated charge wire voltage for different altitudes. E.g. the wire voltage at 1000 $\mu\Delta$ for sea level=−5.28 kV, 1850 m=−4.76 kV, 3000 m=−4.47 kV, and 5000 m=3.75 kV.

In operation of the present invention by ramping up the charge PWM signal, the charge current will ramp up at a known rate. This ramping up should continue until the charge voltage (which is available on the HVPS as a low voltage signal) passes a certain minimum level. Note: During the measurement, the grid voltage should be set to a known value (e.g. −600 V) by means of the grid-PWM signal.

For this level an additional level for triggering the HV fault line is used (or an additional monitor line). Now that the required current level to reach a known charge voltage at a known grid voltage is available to the software (duty cycle level), it is possible to use a "look up table" (which contains the relation between charge current and altitude) to determine the actual altitude, and modify (factor x nominal setting) for other xerographic settings.

FIG. 4 shows the detack AC voltage requirements for different altitudes. These requirements are the result from actual measurements, based on a nominal requirement of 4.2 kV RMS at sea level (factor 1). Detack voltage requirements: (multiplication factors) @ 0' (0 m) 4200 V AC RMS (1), @ 5000' (1500 m) 3663 V AC RMS (0.87), and @ 10,000' (3100 m) 3125 V AC RMS (0.74).

The measurements on the P1B charge scorotron the altitude (at a wire current of 1000 $\mu\Delta$ and a grid voltage of −600V) show the following results: 0 m −5.88 kV factor 1 5.8815.88) 3000 m −4.47 kV factor 0.76 (4.4715.88)

As can be seen from this result, the charge measurement at 3000 m (factor 0.76) is close to the detack measurement at 3100 m (factor 0.74).

In this way also the factor for DT at 1850 m can be calculated 4.7615.88−0.81, which would result in a DT(AC) voltage of 3400 V.

Applicant has also found that the principles of the present invention can also be used to determine humidity characteristics in the printing machine with the use of a temperature sensor. FIG. 5 is a graph which shows the temperature and humidity characteristics of the charge scorotron. In the range from 10° C./10%–28° C/85%, the influence is not very large, however, at 50° C and 1 m Δ wire current the charge voltage varies from −5.55 kV to −6.24 kV at a humidity change from 10% to 85% WRT detack AC compensation.

However, this is merely an advantage, since the described method is also usable to compensate for this influence. Ozone is sucked out of the charge scorotron at machine startup by a blower; next a rough estimate for determining humidity is accomplished by doing two measurements of which the first one has to be done on a cold M/C (start up) and the second one after warm up. After which the relative humidity has dropped because of the temperature rise in the printer. This information could then be used to set the CB/pre-transfer.

It is, therefore, apparent that there has been provided in accordance with the present invention, that fully satisfies the aims and advantages hereinbefore set forth.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. A method for determining an altitude with a corona generating device having a grid and a coronode and a power supply for supply power to said grid and coronode, comprising:

setting the grid at a predefined voltage with the power supply;

applying a charge output voltage and a charge output current to the coronode with the power supply;

monitoring the charge output voltage and the charge output current to the coronode from the power supply until a predefined charge output voltage is reached;

correlating charge output current to an altitude when said predefined charge output voltage is reached.

2. The method of claim 1, wherein said correlating includes measuring a relationship between a charge PWM input signal and the charge output current and attributing the relationship to the altitude.

3. The method of claim 2, wherein said applying includes increasing a duty cycle of the charge PWM input signal until the predefined voltage is reached.

4. The method of claim 2, wherein said applying includes setting a duty cycle of the charge PWM input signal to a fixed value and measuring charge output voltage at said fixed value.

5. The method of claim 1, wherein further comprising sending a signal indicative of said altitude to a machine controller in order to adjust xerographic settings in a xerographic printing machine.

6. An electrostatic printing machine having a method for determining an altitude with a corona generating device having a grid and a coronode and a power supply for supply power to said grid and coronode, comprising:

setting the grid at a predefined voltage with the power supply;

applying a charge output voltage and a charge output current to the coronode with the power supply;

monitoring the charge output voltage and the charge output current to the coronode from the power supply until a predefined charge output voltage is reached;

correlating charge output current to an altitude when said predefined charge output voltage is reached.

7. The method of claim 6, wherein said correlating includes measuring a relationship between a charge PWM input signal and the charge output current and attributing the relationship to the altitude.

8. The method of claim 7, wherein said applying includes increasing a duty cycle of the charge PWM input signal until the predefined voltage is reached.

9. The method of claim 7, wherein said applying includes setting a duty cycle of the charge PWM input signal to a fixed value and measuring charge output voltage at said fixed value.

10. The method of claim 6, wherein further comprising sending a signal indicative of said altitude to a machine controller in order to adjust xerographic settings in a xerographic printing machine.

* * * * *